United States Patent [19]

Iwamatsu

[11] Patent Number: 4,538,291

[45] Date of Patent: Aug. 27, 1985

[54] X-RAY SOURCE

[75] Inventor: Seiichi Iwamatsu, Suwa, Japan

[73] Assignee: Kabushiki Kaisha Suwa Seikosha, Tokyo, Japan

[21] Appl. No.: 438,569

[22] Filed: Nov. 2, 1982

[30] Foreign Application Priority Data

| | | | |
|---|---|---|---|
| Nov. 9, 1981 | [JP] | Japan | 56-179384 |
| Nov. 9, 1981 | [JP] | Japan | 56-179385 |
| Mar. 16, 1982 | [JP] | Japan | 57-41167 |

[51] Int. Cl.[3] ..... H05G 1/00; H01J 35/00

[52] U.S. Cl. ..... 378/119; 378/34; 378/43

[58] Field of Search ..... 378/34, 119, 43

[56] References Cited

U.S. PATENT DOCUMENTS

| | | | |
|---|---|---|---|
| 2,923,852 | 2/1960 | Scott et al. | 378/119 |
| 2,997,436 | 8/1961 | Little et al. | 378/119 |
| 3,089,831 | 5/1963 | Kolb | 378/119 |

*Primary Examiner*—Alfred E. Smith
*Assistant Examiner*—T. N. Grigsby
*Attorney, Agent, or Firm*—Blum, Kaplan, Friedman, Silberman & Beran

[57] ABSTRACT

An X-ray source for producing high intensity X-rays. The X-ray source includes a vessel filled with an inert gas. An energizing mechanism such as a magnetic coil causes the gas to enter a pinch, plasma state which produces high intensity X-rays. The vessel includes a window through which the X-rays are radiated. In a second embodiment, a laser or electron beam bombards a crystal of selected material to produce the X-rays. The material, when gasified, does not interfere with radiation of the X-rays.

14 Claims, 3 Drawing Figures

FIG. 1
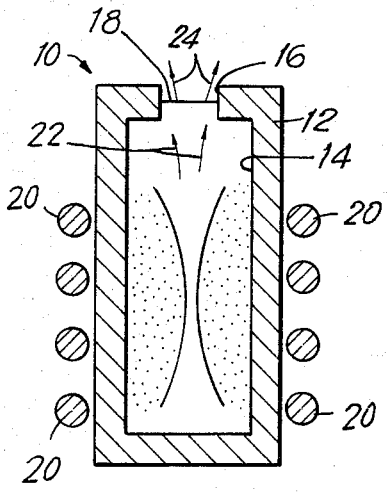
FIG. 2
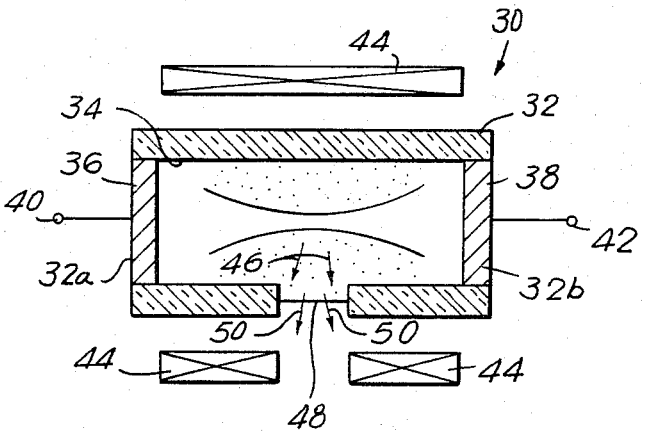
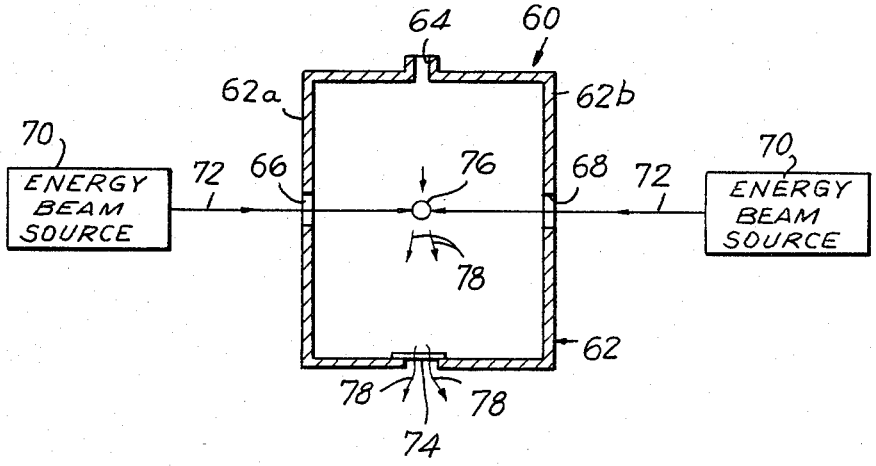
FIG. 3

X-RAY SOURCE

BACKGROUND OF THE INVENTION

The present invention is directed to an X-ray source and, in particular, to an X-ray source device which generates stable, high intensity X-rays with long life.

High intensity X-ray source devices are particularly desirable for use in X-ray lithography and X-ray microscopy. When used in X-ray lithography, X-ray source devices are used during the production phase of semiconductor chips. Conventional X-ray sources such as electron bombardment sources, synchrotrons and laser-driven plasma devices have been investigated for use in X-ray lithography. In conventional electron bombardment X-ray sources, characteristic X-rays are generated by bombarding a fixed or rotating water cooled target, such as an anode made from copper, molybdenum or other such metals, with an electron beam. Such a conventional electron bombardment device suffers from poor efficiency and low output power and high intensity X-rays cannot be produced.

The X-ray flux from synchrotrons is suitable for lithography, but synchrotrons are large, complex and expensive. Laser-driven plasma X-ray sources are promising, but the high power lasers which are required to achieve high conversion efficiencies are often large and expensive and vapors tend to block the X-ray emitting window of such devices.

Various other proposals have been put forth to provide high intensity X-ray sources for use in X-ray lithography and electron microscopy. For example, in an article entitled *Pulsed Plasma Source for X-Ray Lithography* found in SPIE Vol. 275 Semiconductor Microlithography VI (1981) at pages 52–54, a pulsed plasma X-ray source device which produces X-rays by heating a target material to temperatures of several million degrees centigrade is proposed. Such a device produces soft X-rays.

In an article entitled *Flash X-Ray Microscopy* found in Science Vol. 205, July 27, 1979 at pages 401–402, an X-ray tube is proposed which includes a discharge capillary for producing, by erosion of several monolayers of the capillary wall, adense, high-temperature plasma. The tube also contains a rod cathode for launching an intense electron beam into the plasma to enhance the soft X-ray emission thereof. Such a device is useful for wet-sample viewing.

In an article entitled *Gas Plasmas Yield X-Rays for Lithography* found in Electronics, Jan. 27, 1982 at pages 40–41, gas-puff or gas-jet plasma sources are proposed. Such gas-jet plasma sources work by forcing a gas through a special nozzle in short bursts. The nozzle "shapes" the gas into a hollow cylinder. The instant before the cylindrical shape dissipates, electrical energy stored in a capacitor bank discharges through the gas, causing it to implode about the cylinder's axis. The resulting engery monentarily transforms the gas into a compressed plasma, which emits X-rays at wavelengths determined by the composition of the gas.

Although conventional X-ray source devices exist in the art and newly developed X-ray source devices have been proposed, it is still desired to provide an improved X-ray source device which efficiently produces X-rays of high intensity, long life and stability.

SUMMARY OF THE INVENTION

Generally speaking, in accordance with the present invention, an X-ray source for producing high intensity X-rays is provided. The X-ray source includes a vessel having an X-ray emitting window and inert gas fills the vessel. An energizing mechanism such as electrodes or magnetic coils adjacent the vessel to which a high frequency power is applied converts the inert gas in the vessel to a pinch, plasma state. When in the pinch, plasma state, X-rays are produced by the gas which are radiated through the window in the vessel for use as desired.

In a preferred embodiment, the vessel is hollow and made from quartz, ceramic, aluminium, copper or other such material. A separate pair of spaced electrodes can be provided on the vessel wall which produce an electric field to convert the inert gas to a plasma state. A magnetic coil around the vessel generates a magnetic field to cause the plasma to enter into the pinch state so that X-rays of high intensity are radiated through the window of the vessel.

In an alternative embodiment, in addition to filling the vessel with a gas such as argon, nitrogen gas or other such gas, a material such as a pole of ice or a piece of ice is inserted in the vessel. A laser beam or electrode beam is applied to the ice which turns the crystalline ice into the plasma state. The ice is transformed into hydrogen and oxygen gas which do not attach to the interior wall of the vessel or the window so as to prevent blocking of X-rays by the device and loss of efficiency.

Accordingly, it is an object of the present invention to provide an improved X-ray source device.

Another object of the present invention is to provide an X-ray source device in which an inert gas is energized by magnetic coils or electrodes to enter into a pinched, plasma state so as to emit high intensity X-rays.

A further object of the present invention is to provide an X-ray source which generates high-intensity X-rays of long life and stability.

Still a further object of the present invention is to provide an improved X-ray source device in which the gaseous material does not interfere with radiation of the X-rays.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

FIG. 1 is a cross-sectional view depicting an X-ray source device constructed in accordance with a first embodiment of the present invention;

FIG. 2 is a cross-sectional view of an X-ray source device constructed in accordance with a second embodiment of the present invention; and FIG. 3 is a cross-sectional view of an X-ray source device constructed in accordance with a third embodiment of the present invention.

DESCRIPTION OF THE PREFERRED EMBODIMENTS

Reference is first made to FIG. 1 which depicts an X-ray source, generally indicated at 10, constructed in accordance with a first embodiment of the present invention. X-ray source 10 includes a hollow vessel 12 having a chamber 14. Vessel 12 is preferably formed from materials such as quartz, ceramic, aluminium, copper or the like. Vessel 12 includes an opening 16 which defines an X-ray emitting window 18. X-ray emitting window 18 is preferably made from beryillium, polyethylene film or quartz film or materials having similar properties.

An inert gas such as argon or xenon is filled in cavity 14 of vessel 12. A spiral magnetic coil 20 is provided around vessel 12. When coil 20 is energized by the application of a high frequency power thereto, the gas within vesssel 12 turns to a plasma state as depicted in FIG. 1. The plasma is in a pinch state due to the magnetic field created by coil 20 and X-rays indicated by arrows 22 are produced. X-rays 22 are radiated through window 18 and appear as X-rays indicated by arrows 24 for use as desired. The pinch, plasma state of the gas is schematically depicted in FIG. 1.

About 100 KV of high frequency power is required to be applied to magnetic coil 20 to produce a magnetic field of about 10 KJ to place the plasma in the pinch state. The X-rays emitted are of high intensity on the order of 1 KJ where $\lambda \approx 10$Å.

In another embodiment, instead providing a static gas within vessel 12, a vaccum pump can be utilized to continuously supply the gas to vessel 12 to keep the pressure within vessel 12 at a constant level. Instead of spiral coils 20, parallel-plate electrodes can be utilized. Since such electrodes or coils are outside of vessel 12, deterioration thereof can be avoided and stable and high intensity X-rays can be produced by utilizing the pinch effect of the gas discharged plasma where the plasma is produced by supplying a high frequency power to the electrodes or coils.

Reference is now made to FIG. 2 which depicts an X-ray source, generally indicated at 30, constructed in accordance with a second embodiment of the present invention. X-ray source device 30 includes a vessel 32 preferrably made from insulating materials such as quartz, ceramic or the like. Vessel 32 is hollow and includes an inner chamber 34 in which an inert gas such as argon is filled.

Electrodes 36 and 38 are formed on opposing walls 32*a* and 32*b* of vessel 32. A voltage is applied across electrodes 36 and 38 through their respective terminals 40 and 42 to produce an electric field. Magnets or coils 44 are provided outside of vessel 32.

When an AC or DC current is applied to electrodes 36 and 38 through terminals 40 and 42, respectively, the gas within vessel 32 turns to the state of plasma. When power is applied to magnets or coils 44, a magnetic field is generated which causes the plasma within vessel 32 to enter the pinch state as schematically depicted in FIG. 2. High intensity X-rays ($\lambda \approx 10$Å) are produced as indicated by arrows 46 which are radiated through an X-ray emitting window 48 formed in vessel 32. Window 48 is preferably made of beryillium. X-rays are radiated through window 48 as indicated by arrows 50. The intensity of total X-rays produced by such a device is on the order of 1 KJ.

About 100 KV to 500 KV strength of electric field is required to be produced by electrodes 36 and 38 in order to form plasma from the gas within vessel 32. The pinch state is the state in which the high-density plasmas created by the application of the electric field to the gas collide with each other by means of the application of the magnetic field by magnets or coils 44 before the plasmas repulse each other by the coulomb force.

Reference is now made to FIG. 3 which depicts an X-ray source device, generally indicated at 60, constructed in accordance with a third embodiment of the present invention. In conventional X-ray source devices which utilize plasma phenomenon for the generation of X-rays, aluminum, molybdenum, carbon and the like are used as materials in the vessel which are converted to the plasma state in the vaccum of the vessel. However, such conventional methods for generating X-rays have the disadvantage of deteriorating the efficiency of X-ray generation in an X-ray source device. This is due to the fact that the materials are not broken down after being converted to the state of plasma and the materials attach to the X-ray emitting window of the device to decrease the efficiency thereof. The object of the third embodiment of the present invention as depicted in FIG. 3 is to provide an X-ray source without deterioration of efficient X-ray generation.

According to the third embodiment, the material itself is gasified by breakdown, evaporation or the like by applying laser beams or electron beams focussed on the material. The gasified material is readily discharged from the vessel without attachment to the interior wall of the vessel. Therefore, the efficiency of X-ray generation is much improved considering an X-ray source device wherein X-rays are generated by applying laser beams or electron beams to the material to be converted to the state of plasma.

In FIG. 3, X-ray source device 60 includes a vessel 62 preferrably made from a stainless material. Argon or other inert gases, nitrogen gas or other such gases having similar properties are filled up in vessel 62. Vessel 62 includes an opening 64 provided for inserting a material to be converted to plasma. Windows 66 and 68 are provided on opposing sidewalls 62*a* and 62*b*, respectively, of vessel 62. Energy beam source 70 such as lasers produce energy beams 72 such as laser beams which enter vessel 62 through windows 66 and 68, respectively. Windows 66 and 68 are preferably made of quartz or similar material. An X-ray emitting window 74 preferably made from beryillium or the like is provided to allow radiation of X-rays out of vessel 62 for use as desired. A material 76 such as a pole of ice or a piece of ice is inserted into vessel 62 through opening 64 and positioned so that laser beams 72 can be focused thereon.

Radiation of incident laser beam 72 provided by lasers 70 to pole of ice or piece of ice 76 in focus from the exterior of vessel 62 converts the crystalline ice to the plasma state. X-rays 78 having a wavelength of approximately 20 to 40 Angstroms are emitted from X-ray emitting window 74 with intense strength by plasma oscillation.

Ice 76 is transformed into hydrogen gas and oxygen gas. Such gases do not attach to the interior wall of X-ray vessel 62 and do not attach to X-ray emitting window 74. Therefore, the transformation of crystalline ice to such gases does not cause deterioration of the strength of radiation of the X-rays.

In accordance with the third embodiment, there is no possibility of attachment of material to the interior wall of vessel 62 so far as the gaseous product is formed by applying the energy beam. In addition, besides crystalline ice utilized as a material which is transformed into gas by applying the energy beam thereto, a crystal of ammonia, crystals of various inert gases such as argon, krypton, xenon or the like can be applied as materials for use within vessel 62. In addition, a liquid such as water can also be applied for use as such material. Alternatively, a solid such as dry ice can be applied for use as the material. The dry ice is transformed to carbon acid gas in response to the surrounding oxygen atmosphere in the vessel as soon as the energy beam is applied thereto, even though carbon is educed.

When such a reaction that the gaseous product is formed in response to the surrounding atmosphere as soon as the energy beam is applied to the material, various hydrocarbon compounds can be applied for use as the material to be in the plasma state. In accordance with this third embodiment of the present invention, therefore, an effective X-ray source device without deterioration of the strength of radiation of X-rays can be provided by forming the gaseous product after the energy beam is applied to the material. The strength of laser beams 72 produced by laser 70 and the strength of electron beams, where such electron beams are utilized instead of laser beams, should be about $10^{14}$ W/cm$^2$ and the time for applying the beams to the material should be on the order $10^{31\ 9}$ seconds. Crystals of argon, krypton, xenon or other such inert elements can be utilized for the material which is converted to the plasma state.

In accordance with the present invention, three embodiments of an X-ray source device are provided which produce high intensity X-rays on the order of 1 KJ which are long lived and stable. The devices are easy to construct and produce the high intensity X-rays required for such operations as X-ray lithography for use in manufacturing semiconductor chips.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. An X-ray source comprising a vessel, inert gas filling said vessel, and energizing means for causing said inert gas to enter a plasma state, said inert gas when placed in a plasma state producing X-rays, said vessel including window means for permitting said X-rays to radiate out of said vessel, said energizing means including a pair of spaced electrodes on said vessel, said electrodes, when energized, causing said inert gas to enter the plasma state, said energizing means further including coil means around said vessel for generating a magnetic field to cause said plasma to enter the pinch state so that X-rays are produced and radiated through said window means.

2. The X-ray source as claimed in claim 1, wherein the output energy strength of said magnetic field is about 10 KJ.

3. The X-ray source as claimed in claim 2, wherein between substantially 100 KV and 500 KV is applied across said electrodes.

4. The X-ray source as claimed in claim 1, wherein said vessel is hollow and made from an insulating material.

5. The X-ray source as claimed in claim 4, wherein said insulating material is selected from the group consisting of quartz and ceramic.

6. The X-ray source as claimed in claim 1, wherein AC current is applied to said electrodes.

7. The X-ray source as claimed in claim 1, wherein DC current is applied to said electrodes.

8. An X-ray source comprising a vessel, inert gas filling said vessel, and energizing means for causing said inert gas to enter a plasma state, a high frequency power being applied to said energizing means, said inert gas when placed in a plasma state producing X-rays, said vessel including window means for permitting said X-rays to radiate out of said vessel, said energizing means including magnetic coil means adjacent said vessel for creating a magnetic field when said high frequency power is applied thereto for causing said inert gas to enter the plasma state, said coil means being a high-frequency coil, with between substantially 100 KV and 500 KV being applied to said coil as said high-frequency power.

9. The X-ray source as claimed in claim 8, wherein the output energy strength of said magnetic field is about 10 KJ.

10. The X-ray source as claimed in claim 8, wherein said energizing means includes a pair of spaced electrodes on said vessel, said electrodes, when energized, causing said inert gas to enter the plasma state.

11. The X-ray source as claimed in claim 9, wherein said coil means, when said high frequency power is applied thereto, causes said inert gas to enter a pinch, plasma state, the pinch, plasma state of said gas creating X-rays which are radiated through said window means.

12. The X-ray source as claimed in claim 11, wherein said vessel is made from a material selected from the group consisting of quartz, ceramic, aluminum and copper.

13. The X-ray source as claimed in claim 12, wherein said window means is made from a material selected from the group consisting of beryllium, polyethylene film and quartz film.

14. The X-ray source as claimed in claim 13, wherein said inert gas is selected from the group consisting of argon and xenon.

* * * * *